US008562047B2

(12) United States Patent
Parker

(10) Patent No.: US 8,562,047 B2
(45) Date of Patent: Oct. 22, 2013

(54) LIFTING HOOK FOR ERECTING STEEL JOISTS

(76) Inventor: James R. Parker, Phoenix, AZ (US)

( * ) Notice: Subject to any disclaimer, the term of this patent is extended or adjusted under 35 U.S.C. 154(b) by 0 days.

(21) Appl. No.: 13/492,562

(22) Filed: Jun. 8, 2012

(65) Prior Publication Data

US 2013/0099516 A1 Apr. 25, 2013

Related U.S. Application Data

(60) Provisional application No. 61/551,075, filed on Oct. 25, 2011.

(51) Int. Cl.
*B66C 1/62* (2006.01)

(52) U.S. Cl.
USPC ..... 294/82.16; 294/67.32

(58) Field of Classification Search
USPC ..... 294/81.52, 81.53, 67.32, 82.1, 82.11, 294/82.16, 89, 93
See application file for complete search history.

(56) References Cited

U.S. PATENT DOCUMENTS

| | | | | | |
|---|---|---|---|---|---|
| 718,506 | A * | 1/1903 | Normandin | 294/81.52 |
| 1,525,090 | A * | 2/1925 | Rutan | 294/82.16 |
| 3,381,925 | A * | 5/1968 | Higuchi | 410/116 |
| 3,420,014 | A * | 1/1969 | Courtois et al. | 52/125.4 |
| 3,443,832 | A * | 5/1969 | Ehlinger | 294/68.3 |
| 3,677,599 | A * | 7/1972 | Shannon | 294/81.53 |
| 3,980,185 | A * | 9/1976 | Cain | 206/509 |
| 4,079,983 | A * | 3/1978 | Van Mastrigt | 294/89 |
| 4,297,963 | A * | 11/1981 | Beacom | 114/230.29 |
| 7,422,257 | B2 | 9/2008 | Neufeldt | |
| 2011/0006555 | A1 * | 1/2011 | Swisher | 294/81.53 |

OTHER PUBLICATIONS

Web Page Advertisement—Freedom Tools LLC.

* cited by examiner

*Primary Examiner* — Dean Kramer
(74) *Attorney, Agent, or Firm* — John D. Titus

(57) ABSTRACT

A lifting hook for lifting open-frame steel joists comprises a casing having a shaft passing through it. The shaft has a lifting eye at one end and a hook member at the other end. The hook member comprises a U-shaped body having a transverse width selected to be less than the gap between the angles that form the upper flange of the open-frame joist. The hook member has a throat that is larger than the width of the flange. The shaft is spring-loaded so that the hook member is pulled toward the lower bearing surface of the casing so that once the hook member has been inserted into the joist, it is keyed to the flange and will not come loose.

2 Claims, 3 Drawing Sheets

LIFTING HOOK FOR ERECTING STEEL JOISTS

This application claims priority of U.S. Provisional Patent Application 61/551,075, filed on Oct. 25, 2011.

BACKGROUND OF THE INVENTION

This invention relates generally to construction equipment and, in particular, to methods and apparatus for lifting open-web steel trusses.

It is well known in the commercial construction industry to use standard prefabricated steel Warren trusses to support floors and roofs of structures such as office buildings and hotels where loads are moderate and the spans between supports are relatively long. These trusses, often referred to as open-web steel joists are generally made of light structural members such as angles, bars and channels.

Open-web steel joists are commonly manufactured in three standard categories. The standard K-series joists are fabricated using a double-angle top and bottom chord and a round bar web having a depth of from 8 inches to 30 inches. K-Series joists are recommended for spans from 8 feet to 60 feet in length. Other standard open-web steel joists include the LH-series which have a depth of from 18 to 48 inches and may be used for spans of 25 feet to 96 feet and the DLH-series joists which have a depth of from 52 inches to 72 inches and are recommended for spans of 89 feet 244 feet.

Open-web steel joists are very economical structural members since they are fabricated from standard lightweight structural steel shapes such as angles and bars. Because the webs are open, they are able to span long distances without the dead weigh load of a solid I-beam. Moreover, because of the open-web design, is possible to run plumbing, electrical lines and ventilation ducts directly through the web itself, which results in considerable savings in floor-to-floor height and weight.

Although open-web steel joists have very favorable strength to weight ratio for vertical loads (i.e. loads applied parallel to the depth, which is the axis having the maximum area moment of inertia), open web steel joists have considerably less strength when resisting side loads (i.e. loads applied to the axis having the minimum area moment of inertia). Consequently, open-web steel joists must be handled carefully especially during loading, transport, unloading and positioning prior to final placement.

The Steel Joist Institute recommends that when lifting an open-web steel joist using a crane (either during loading, unloading or during final placement), the crane operator should use two chokers configured in a basket hitch with two-way spreaders. The chokers should be rigged passing through the inside of the inverted V-shaped opening in the web. The Institute cautions that when using chokers (with or without spreaders), care must be taken to avoid damaging (e.g. bending) the rod members that form the web. Carefully rigging and unrigging chokers and spreaders, however, is cumbersome and time-consuming. Accordingly, a need exists for a method and apparatus to quickly rig and unrig the open-web steel joists from the lifting crane.

One prior art apparatus, marketed commercially as the E-Z Joist Release™ by Freedom Tools LLC of Mesa Ariz., comprises a horizontal flange welded to a vertical web adapted to receive a lifting hook or shackle. The horizontal flange has a hole at each end through which a vertical rotating shaft is mounted. Each of the rotating shafts has a shank that is sized to pass through the gap between the structural angles that make up the top flange of the truss. The rotating shafts terminate at their lower ends with an inverted triangular tip, which when rotated 90° is unable to pass through the gap in the top flange. The horizontal flange also has two vertical tongues adjacent the rotating shafts. The vertical tongues are also sized to pass through the gap in the top flange and serve as guides to key the device to the top flange of the truss. In operation, the device is placed on top of the truss so that the tongues and rotating shafts pass through the gap in the top flange. A lever attached to the rotating shafts is pulled which causes the shafts to rotate 90° to lock the device in position. Once the truss has been moved to its desired location, the lever is returned to its original position so the device can be released from the truss. The E-Z Joist Release has several disadvantages. It is expensive. It may not be easily adaptable to joists having different-size upper flanges because the rotating tip is at a fixed depth. Additionally, the E-Z Joist Release may damage the web members if the tongues and/or rotating shafts come in contact with the web.

Accordingly, what is needed is a joist lifting tool that is inexpensive, easy to use, and safe.

SUMMARY OF THE INVENTION

The present invention comprises a lifting hook for lifting open-frame steel joists. According to an illustrative embodiment of the invention, the lifting hook comprises a casing having a shaft passing through it. The shaft has a lifting eye at one end and a hook member at the other end. The hook member comprises a U-shaped body having a transverse width selected to be less than the gap between the angles that form the upper flange of the joist. The hook member has a throat that is larger than the width of the flange. The shaft is spring-loaded so that the hook member is pulled toward the lower bearing surface of the casing.

In operation, the hook member is fed through the gap until the lower bearing surface of the casing comes into contact with the upper flange of the joist. The hook member is then extended downward against the force of spring until it is below the lower surface of the flange of the joist. The hook member is then rotated approximately 90° and released, which allows the spring to move the hook member upward until the flange of the joist is pressed between the hook member and the lower bearing surface of the casing. The flanges of the U-shaped hook member grip the top flange to prevent the hook member from rotating back and disengaging.

BRIEF DESCRIPTION OF THE DRAWING

The present invention will be better understood from a reading of the following detailed description, taken in conjunction with the accompanying drawing figures in which like references designate like elements and, in which.

DETAILED DESCRIPTION

Figure 1:
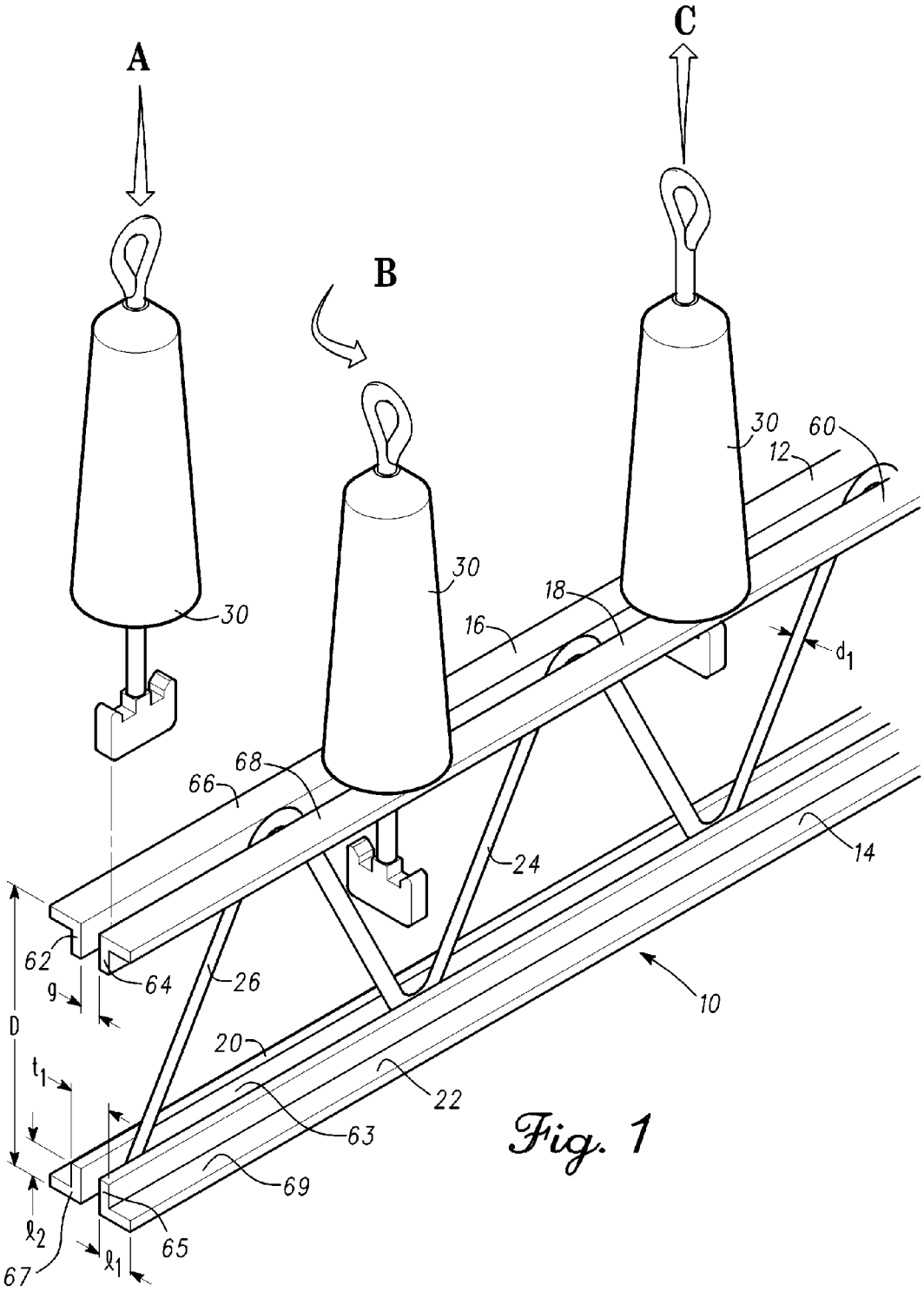
FIG. 1 is a front perspective view of a lifting hook incorporating features of the present invention being attached to an open-web steel truss.

The drawing figures are intended to illustrate the general manner of construction and are not necessarily to scale. In the detailed description and in the drawing figures, specific illustrative examples are shown and herein described in detail. It should be understood, however, that the drawing figures and detailed description are not intended to limit the invention to the particular form disclosed, but are merely illustrative and intended to teach one of ordinary skill how to make and/or use the invention claimed herein and for setting forth the best mode for carrying out the invention.

With reference to FIG. 1, a conventional open-web steel truss 10 comprises a top flange 12 and a bottom flange 14 each of which is formed from two symmetrical structural angles 16, 18, 20 and 22. Each of structural angles 16-22 have vertical legs 62, 63, 64 and 65 as well as horizontal legs 66, 67, 68, 69. Each of horizontal legs 66-69 have a length "$l_1$" and each of the vertical legs 62-65 have a length "$l_2$" the dimensions of which are selected to withstand the particular loads required. Top flange 12 and bottom flange 14 are connected together in a spaced-apart configuration having a web-depth "D" by means of an open web 24. Web 24 is made from a structural steel round bar or rod 26 which forms a series of Vee's typical of a Warren truss. Structural rod 26 has a diameter "$d_1$." Consequently there is a gap "g" equal to or slightly greater than the diameter of structural rod 26 between the vertical legs 62 and 64 of structural angles 16 and 18 forming top flange 12 and a similar gap equal to or slightly greater than the diameter of structural rod 26 between the vertical legs 63 and 65 of structural angles 20 and 22. In a conventional K-series truss, the legs of the angles leg "$l_1$" and "$l_2$" are typically from 1 inches to 4 inches while the diameter of the structural rod 26 is typically from ⅜ inches to 1-½ inches.

Figure 2:
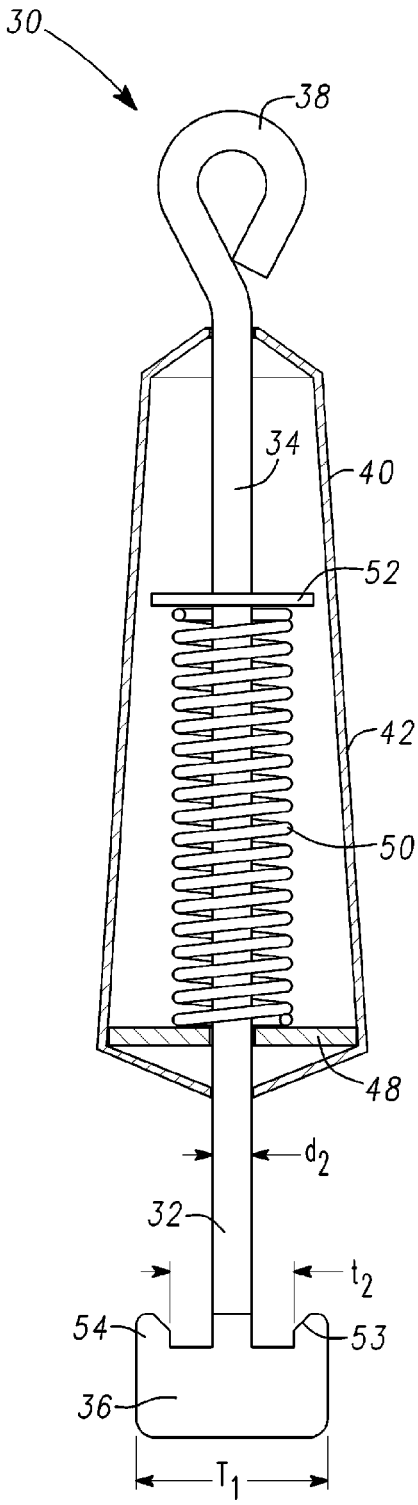
FIG. 2 is a front section view of a lifting hook incorporating features of the present invention in the open position.
Figure 3:
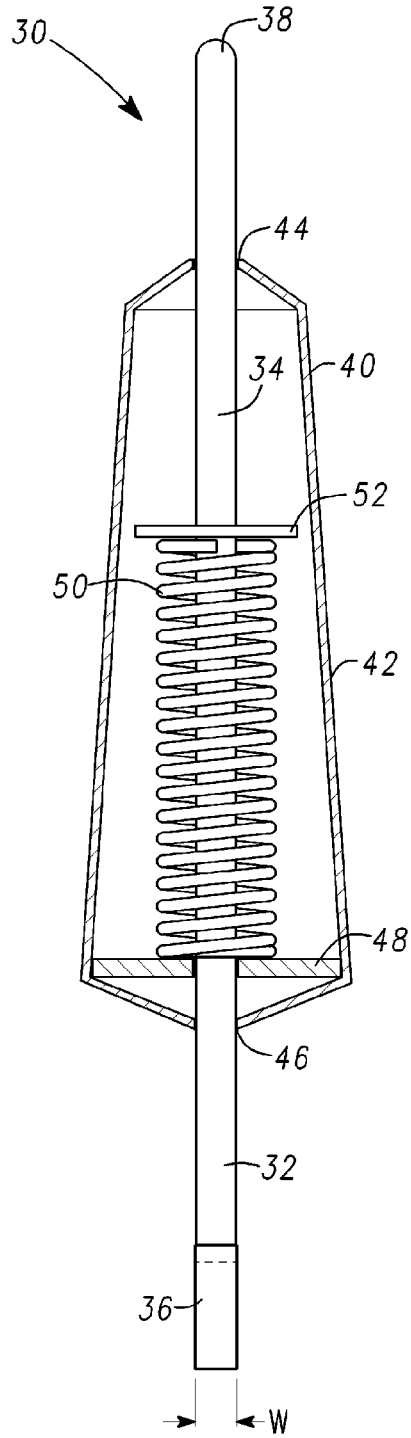
FIG. 3 is a side section view of the lifting hook of FIG. 2.
Figure 4:
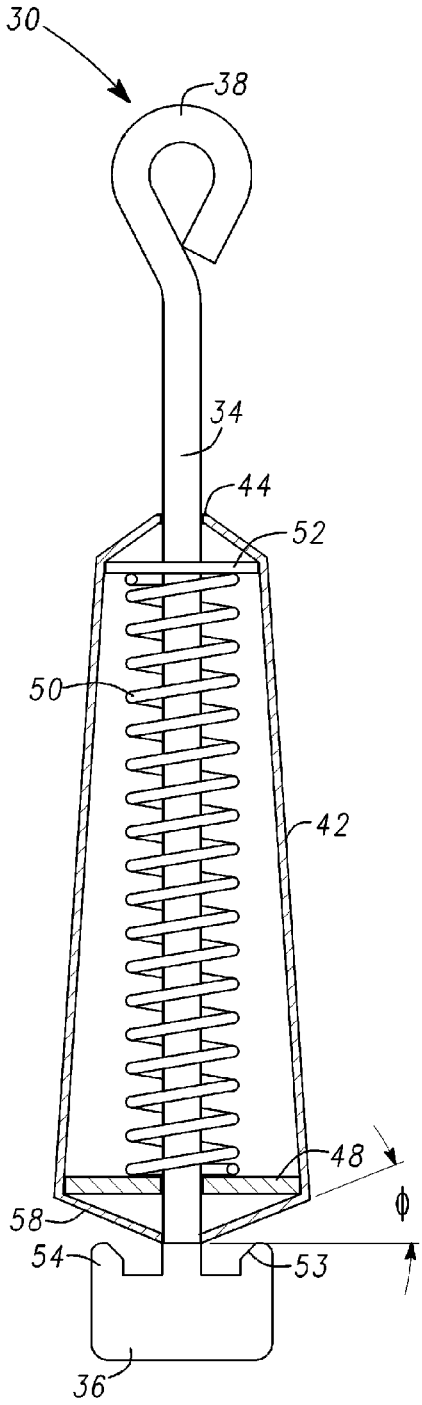
FIG. 4 is a front section view of the lifting hook tool of FIG. 2 in the closed position.

With reference to FIGS. 2-4, a lifting hook 30 incorporating features of the present invention comprises a longitudinal shaft 32, made of steel or similar high-strength material, comprising a shank 34 and a hook member 36 at the lower end. In the illustrative embodiment, longitudinal shaft 32 terminates at the upper end in a lifting eye 38, which is adapted to receive a lifting hook, shackle or other conventional means for connection to a lifting cable from a crane, derrick or similar lifting device. Although the illustrative embodiment comprises a lifting eye 38, any conventional means for attaching a lifting cable, such as a lug, chain plate or threaded fastener may be substituted within the contemplation of the present invention. Hook member 36 comprises a generally U-shaped steel body having a transverse thickness "$T_2$" and throat "$t_2$." The throat dimension "$t_2$." is selected to be slightly larger than the dimension "$t_1$," which is the distance between the outer surfaces of the vertical legs 62 and 64 of the angles 16 and 18 that form top flange 12. The upright flanges 53 and 54 of hook member 36 are chamfered inward as shown in FIG. 2 to guide hook member 36 into position as described hereinafter.

The diameter "$d_2$" of shank 34 is selected to be less than the gap "g" between the structural angles 16 and 18 forming top flange 12. Similarly the transverse width "w" of hook member 36 (FIG. 3) is selected to be less than the gap "g" between the structural angles 16 and 18 forming top flange 12. For reasons discussed more fully hereinafter, the selection of the dimensions "$d_2$" and "w" ensure that hook member 36 and shank 34 can pass through the gap "g" in top flange 12. In the illustrative embodiment, "$d_2$" and "w" are between ⅜ inch and 1½ inch, preferably between ⅜ and ⅝ inch and the overall length of lifting hook 30 is approximately 18 inches.

Lifting hook 30 further comprises a casing 40 which comprises a generally tubular or conical shell 42 having an upper opening 44 and a lower opening 46. Casing 40 further comprises a rigid floor 48. A resilient member, such as a compression spring 50 acts between the floor 48 and spring perch 52 formed on or attached (e.g. welded) to shank 34 of longitudinal shaft 32. Spring 50 urges longitudinal shaft 32 upward towards a closed position as shown in FIG. 4. Compression spring 50 may be of any suitable size, but in the illustrative embodiment comprises a conventional cylindrical compression spring having a free length of about 8-¾ inches and a spring rate of preferably between 2 lb/in and 20 lb/inch preferably about 6-¾ lb/in such that in the maximum open position (4-½ inch stroke) the spring is exerting a restoring force of about 35 pounds and in the fully-closed position (installed height of 8 inches) is exerting a force of about 5 pounds.

With reference in particular to FIG. 1, in operation, lifting hook 30 is moved into position by the crane operator (not shown) with sufficient slack to enable the user to insert the hook member 36 and shank 34 through the gap between angles 16 and 18 forming upper flange 12. With the hook member 36 oriented longitudinally with respect to the gap "g" between angles 16 and 18 as shown in FIG. 1A, lifting hook 30 is fed through the gap until the lower bearing surface 58 of the casing 40 comes into contact with the horizontal legs of angles 16 and 18. Because lower bearing surface 58 is larger than the gap "g" the downward motion of casing 40 is arrested. Pressing against lifting eye 38, the user extends hook member downward against the force of spring 50 until upright flanges 53 and 54 of hook member 36 are below the vertical legs 62 and 64 of angles 16 and 18. Still manipulating lifting eye 38, the user rotates hook member 36 approximately 90° to orient hook member as shown in FIG. 1B The user then releases lifting eye 38, which allows spring 50 to move lifting hook 30 toward the closed position with angles 16 and 18 pressed between hook member 36 and lower bearing surface 58 of casing 40. The upright flanges 53 and 54 of hook member 36 extend past the vertical flanges 62 and 64 of angles 16 and 18 as shown in FIG. 1C which locks lifting hook 30 against rotation thereby preventing hook member 36 from disengaging top flange 12. The lifting force from the crane, of course, only further locks the engagement between lifting hook 30 and truss 10.

Figure 5:
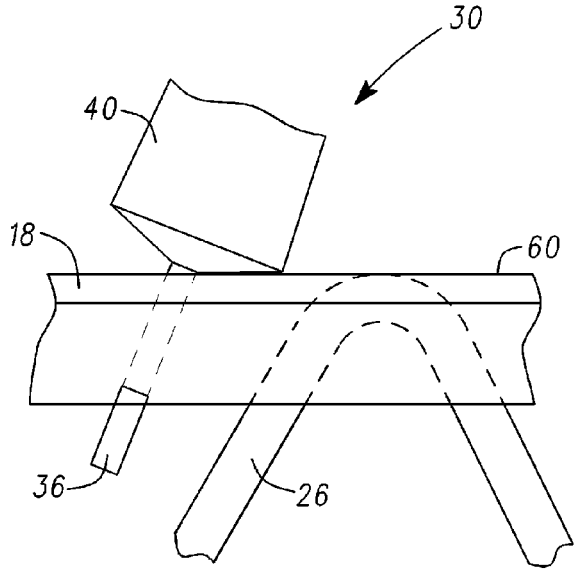
FIG. 5 is a partial side view of the lifting hook of FIG. 2 showing details of the engagement between the lifting hook and the top flange of an open-web steel truss.

With reference to FIGS. 4 and 5, the lower bearing surface 58 of casing 40 is conical in shape, having a conical angle $\phi$ selected to match the maximum anticipated angle between the lifting cable and the top surface 60 of top flange 12 of truss 10. For example, if the lift is to be made with two 30 foot cables without spreaders, spaced apart along the truss by 30 feet, the cables would make a 60° angle with respect to the top surface 60 and, therefore, upper jaw surface 58 would have a conical angle of 90°-60°=30°. Use of spreaders will, of course reduce the cable angle to below 60°. Accordingly, conical angle $\phi$ is typically between 15° and 45° and, most preferably between 25° and 35° and most preferably about 30°.

Although certain illustrative embodiments and methods have been disclosed herein, it will be apparent from the foregoing disclosure to those skilled in the art that variations and modifications of such embodiments and methods may be made without departing from the invention. For example although in the illustrative embodiment, lower bearing surface 58 is conical, other tapered surfaces such as a spherical lower surface are considered within the scope of the invention. Similarly, although in the illustrative embodiment shank 32 is circular in cross section, a rod with square, hexagonal or other cross-sectional shape is considered within the scope of the invention. Accordingly, as used herein, "diameter" when used in connection with shank 32 means the maximum diagonal of a rod with a non-circular cross section as well as the diameter of a rod with circular cross-section. Additionally, although in the illustrative embodiment hook member 36 is generally U-shaped, other hook members such as a T-shaped or W-shaped hook member that can be rotated to lock the lifting hook to the truss are also considered within the scope of the invention. Accordingly, it is intended that the invention should be limited only to the extent required by the appended claims and the rules and principles of applicable law. Additionally, as used herein, references to direction such as "up" or "down" are intend to be exemplary and are not considered as limiting the invention and, unless otherwise specifically defined, the terms "substantially" or "generally" when used with mathematical concepts or measurements mean within ±10 degrees of angle or within 10 percent of the measurement, whichever is greater.

What is claimed is:

1. A method of lifting an open-frame steel joist, said open-frame steel joist comprising a double-angle flange with an open web, the double angle flange having a gap "g" between the upright legs of the angles that form the double-angle flange and a dimension "$t_i$," which is the distance between the outer surfaces of the vertical legs of the angles that form the double-angle flange, the method comprising:

providing a lifting hook, said lifting hook comprising a casing, a shaft and a resilient member, the casing having a lower bearing surface, the shaft comprising an elongate rod having a diameter selected to be less than the gap "g" between the upright legs of the double-angle flange, the elongate rod passing through the casing and having a hook member disposed outside of and adjacent to the lower bearing surface of the casing, the hook member comprising a generally U-shaped body having a transverse width "w" selected to be less than gap "g" of the double-angle flange and throat dimension "$t_2$" selected to be larger than the dimension "$t_1$," of the double-angle flange, the resilient member urging the hook member toward the lower bearing surface of the casing, inserting the hook member between the upright legs of the angles that form the double-angle flange until the lower bearing surface of the casing engages the flange;

pressing against the shaft with hand pressure to extend the hook member against the force of the resilient member until the hook member extends below the double-angle flange;

rotating the shaft approximately 90°; and releasing the hand pressure to allow the resilient member to move the hook member upward to engage the double-angle flange.

2. The method of claim 1, further comprising:

attaching a lifting cable to the lifting hook and lifting the open-frame steel joist with a crane.

* * * * *